US005687836A

United States Patent [19]

Gjerde

[11] Patent Number: 5,687,836

[45] Date of Patent: Nov. 18, 1997

[54] ELECTRICAL SWITCH ASSEMBLY ACTUATABLE BY A ROTATABLE MEMBER

[75] Inventor: Richard Gjerde, Braceville, Ill.

[73] Assignee: Illinois Tool Works Inc., Glenview, Ill.

[21] Appl. No.: 647,430

[22] Filed: May 22, 1996

[51] Int. Cl.[6] ..... H01H 19/20

[52] U.S. Cl. ..... 200/569; 200/568; 200/294; 200/246; 200/247

[58] Field of Search ..... 200/569, 568, 200/564, 336, 245, 246, 247, 249, 250, 572, 284, 558, 559, 239, 300, 294, 296, 293, 295

[56] References Cited

U.S. PATENT DOCUMENTS

| | | | |
|---|---|---|---|
| 2,182,715 | 12/1939 | Yeske | 200/569 |
| 2,644,062 | 6/1953 | Williams | 200/596 |
| 3,221,115 | 11/1965 | Feher, Jr. . | |
| 3,436,165 | 4/1969 | Gehrke . | |
| 3,497,643 | 2/1970 | Heath | 200/336 |
| 3,502,835 | 3/1970 | Batcheller . | |
| 3,971,904 | 7/1976 | Ward . | |
| 4,002,872 | 1/1977 | Desio . | |
| 4,059,738 | 11/1977 | Mongeau | 200/569 |
| 4,123,633 | 10/1978 | Stevens et al. . | |
| 4,249,047 | 2/1981 | Huff et al. . | |
| 4,282,415 | 8/1981 | Shimizu | 200/336 |
| 4,342,880 | 8/1982 | Demi . | |
| 4,761,525 | 8/1988 | Stumpff et al. | 200/284 |
| 5,541,377 | 7/1996 | Stuhlmacher | 200/295 |

*Primary Examiner*—David J. Walczak
*Attorney, Agent, or Firm*—Schwartz & Weinrieb

[57] ABSTRACT

An electrical switch assembly actuatable by a rotatable member wherein the switch assembly includes a polysulfone housing having a hub with a peripheral camming surface and a hub aperture. The hub is rotatably disposed in the housing wherein the rotatable member is disposable through a housing aperture and into the hub aperture for engagement with the hub. A pair of substantially similar resilient electrical contact blades are disposed in the housing in spaced relation wherein each resilient electrical contact blade has at least one wire engagement portion accessible through a wire aperture in the housing. The hub is rotatable by the rotatable member so as to cause the peripheral camming surface of the hub with one of the resilient electrical contact blades and thereby flex the engaged resilient electrical contact blade into electrical contact with the other resilient electrical contact blade. The housing is a two part assembly having a fluid resistant interface. A mounting member is disposed on an outer surface of the housing for coupling the switch assembly to a gas valve assembly.

23 Claims, 2 Drawing Sheets

ELECTRICAL SWITCH ASSEMBLY ACTUATABLE BY A ROTATABLE MEMBER

BACKGROUND OF THE INVENTION

The invention relates generally to electrical switch assemblies actuatable by rotatable members, and more particularly to an electrical switch assembly fixedly mountable relative to a gas valve assembly and actuatable by a rotatable valve stem, wherein the switch assembly is usable to control electrical circuitry for gas ignition.

Electrical switch assemblies actuatable by rotatable members have many applications, and any improvements therefore have enormous market place potential. Manufacturers of natural gas fueled cooking appliances, for example, have for years used electrical switch assemblies coupled to rotatable gas valve stems to control gas ignition circuitry, which eliminates the need for burning wasteful gas pilot lights. U.S. Pat. No. 3,971,904 to Ward discusses an electrical ignition switch actuatable by a rotatable gas valve stem, typical of many electrical switch assemblies. Generally, the switches include a housing having a rotatable cam member coupled to the valve stem wherein the cam member flexes a first electrical contact blade into engagement, at least momentarily, with a second electrical contact blade. A disadvantage of these known switch assemblies is that the first and second electrical contact blades each have a unique shape or configuration, which must be formed in a separate fabrication process resulting in increased costs. In Ward, each electrical contact blade also has a relatively thin flexible end portion for forming the electrical contact and a relatively thick terminal end portion for connecting with a wire through the housing, which further increases costs.

Some applications including gas fueled cooking appliances require that the electrical switch assembly be connected in a parallel electrical circuit configuration. Many prior art electrical switch assemblies, however, provide only two wire connection terminals, one for each electrical contact blade. Connecting a two terminal switch assembly in a parallel circuit configuration therefore requires splicing wires, which is laborious and time consuming, or a custom fabricated interconnecting wire assembly, which is expensive. Other applications require that the switch assembly housing be fluid resistant. Solutions to the fluid resistance problem include providing a sealed housing or an additional sealing member. But sealed housings are often inaccessible for purposes of releasing the wires from the terminals, and additional sealing members complicate assembly and increase costs.

In view of the discussion above, there exists a demonstrated need for an advancement in the art of electrical switch assemblies.

OBJECTS OF THE INVENTION

It is therefore an object of the invention to provide a novel electrical switch assembly that overcomes the problems with the prior art.

It is also an object of the invention to provide a novel electrical switch assembly that is economical and reliable.

It is another object of the invention to provide a novel electrical switch assembly that has substantially similar electrical contact blades formable in the same fabrication process.

It is a further object of the invention to provide a novel electrical switch assembly with a sufficient number of wire terminals for connection of the switch assembly in a parallel electrical circuit configuration without the use of spliced wires or custom wire assemblies.

It is still another object of the invention to provide a novel electrical switch assembly having a fluid resistant housing the interior of which is accessible for disconnecting wires from the electrical contact blades without damage to the wires.

It is a yet further object of the invention to provide a novel electrical switch assembly with a mounting member for coupling the electrical switch assembly with a gas valve assembly.

SUMMARY OF THE INVENTION

Accordingly, the present invention is drawn to a novel electrical switch assembly actuatable by a rotatable member wherein the switch assembly includes a housing having a hub with a peripheral camming surface and a hub aperture. The hub is rotatably disposed in the housing wherein the rotatable member is disposable through a housing aperture and into the hub aperture for engagement with the hub. A pair of substantially similar resilient electrical contact blades are disposed in the housing in spaced relation wherein each resilient electrical contact blade has at least one wire engagement portion accessible through a wire aperture in the housing. The wire engagement portion of each resilient electrical contact blade has a resilient leg with an edge portion biased toward a retention surface. The resilient leg is flexible away from the retention surface by a wire which is disposed through the wire aperture so as to permit insertion of the wire between the edge portion of the resilient leg and the retention surface whereby the wire is retained in electrical contact with the resilient electrical contact blade. The hub is rotatable by the rotatable member so as to engage the peripheral camming surface of the hub with one of the resilient electrical contact blades and thereby to flex the engaged resilient electrical contact blade into electrical contact with the other resilient electrical contact blade. The housing includes a first housing portion matably engagable with a second housing portion wherein the first and second housing portions form a fluid resistant interface so as to prevent fluid from entering the housing. The housing includes a wire release aperture with a breakable partition wall adjacent each wire aperture so as to provide access to the interior of the housing for releasing the wire from the wire engagement portion of the resilient electrical contact blade. A mounting member is disposed on an outer surface of the housing for coupling the switch assembly to a gas valve assembly.

BRIEF DESCRIPTION OF THE DRAWINGS

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators throughout the several views, and wherein.

DETAILED DESCRIPTION OF THE INVENTION

The electrical switch assemblies in the exemplary embodiments disclosed herein are usable in combination with gas valve assemblies having a rotatable valve stem and commonly used in modern gas fueled cooking appliances wherein the electrical switch assembly is usable to control electrical circuitry that ignites gas upon rotation of the valve stem. More generally, however, the electrical switch assemblies are usable in any application having a rotatable member usable to actuate the switch.

Figure 1:
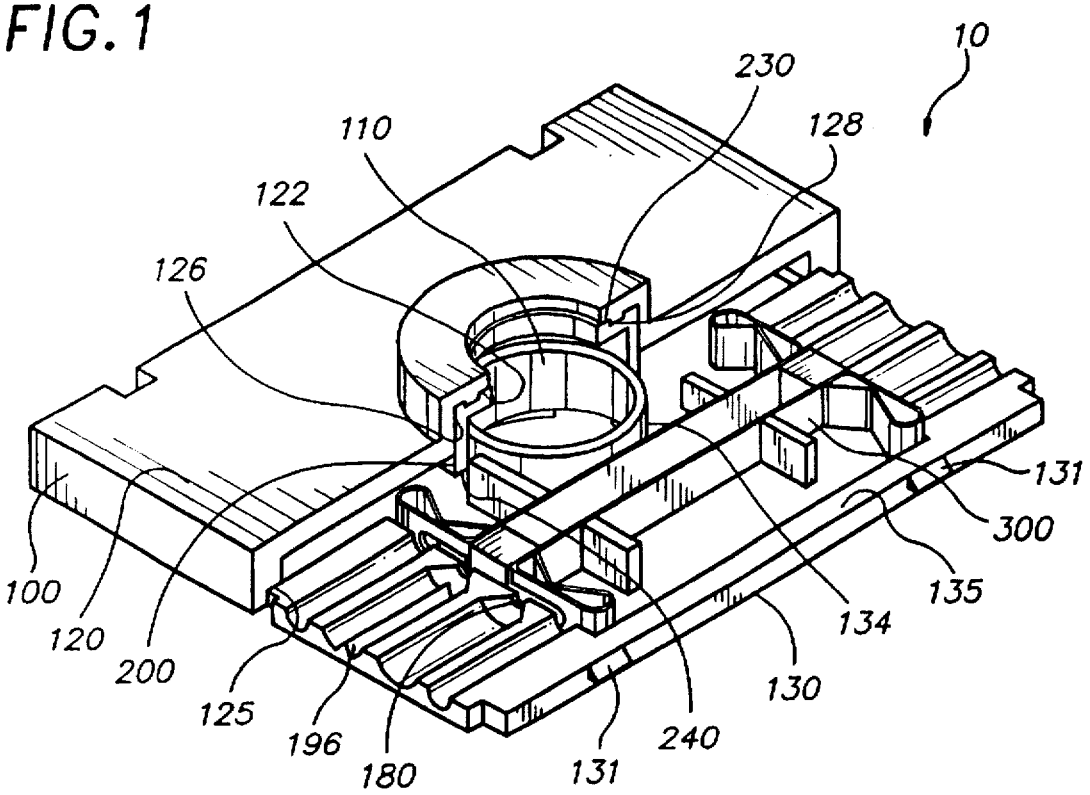
FIG. 1 is a partial perspective view of an electrical switch assembly according to an exemplary embodiment of the invention.
Figure 2:
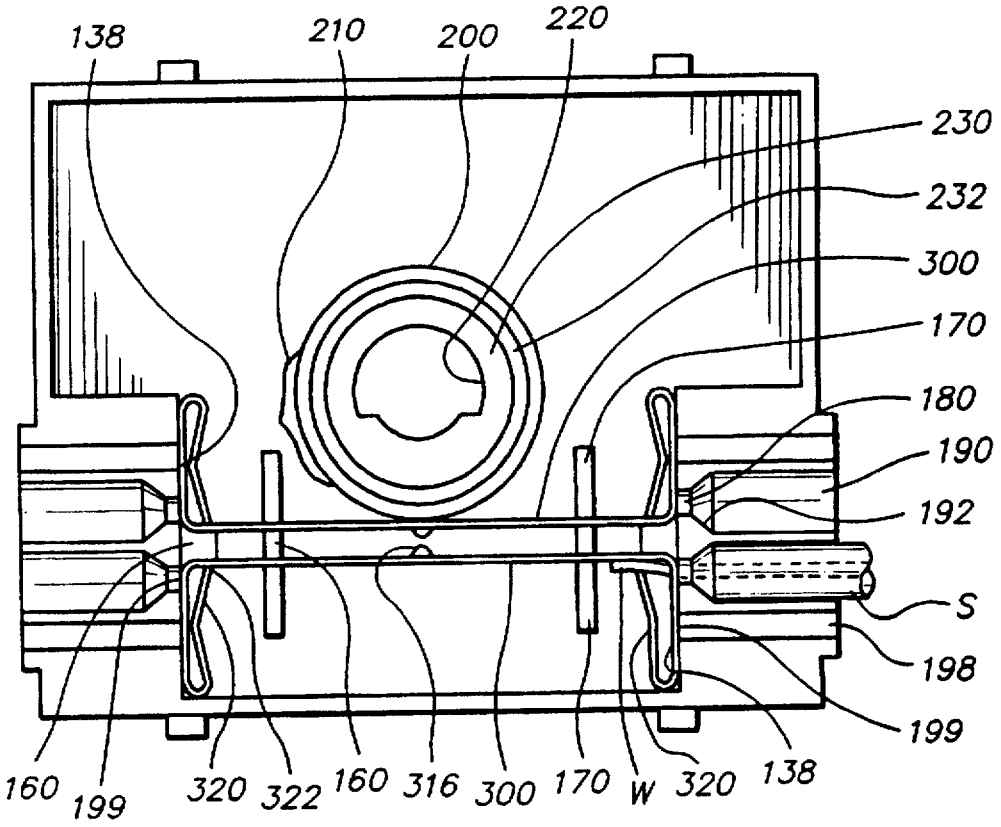
FIG. 2 is a partial plan view of the electrical switch assembly of FIG. 1.

FIG. 1 is a partial perspective view of an electrical switch assembly 10 according to an exemplary embodiment of the invention. The assembly includes a housing 100 with an aperture 110, and a hub 200 having at least one peripheral camming surface 210, best shown in FIG. 2, rotatably disposed in the housing 100. The hub 200 includes a hub aperture 220 accessible axially through the housing aperture 110 by a rotatable member, not shown in the drawing, which is disposable engagably in the hub aperture 220. A peripheral surface of the rotatable member cooperates with the hub aperture 220 so as to permit rotation of the hub 200 within the housing 100 upon rotation of the rotatable member. FIG. 2 illustrates a substantially D-shape hub aperture 220 for engaging a flat surface common on rotatable valve stems so as to permit rotation of the hub 200. Alternative embodiments of the hub aperture may include any configuration including a combination of axial grooves and ridges or a combination key and slot, which are engageable with the rotatable member so as to permit rotation of the hub 200. A pair of resilient electrical contact blades 300 are disposed in the housing 100 in electrically isolated space relation wherein each contact blade 308 includes at least one wire engagement portion 320 electrically connectable with a wire from the exterior of the housing 100. The hub 200 is rotatable so as to cause engagement of the peripheral camming surface 210 with one of the resilient electrical contact blades 300 and thereby flex the engaged resilient electrical contact blade 300 into electrical contact with the other resilient electrical contact blade 300, which actuates the switch assembly.

Generally, the pair of substantially similar resilient electrical contact blades 300 are positioned adjacent the rotatable hub 200 so that peripheral camming surface 210 is engageable with one of the blades 300 so as to flex the engaged blade 300 into electrical contact with the other blade 300. In one embodiment, the contact member 316 is urged into electrical contact with the contact member 316 of the other blade 300. The blades 300 are spaced so that during electrical contact therebetween, both blades 300 are flexed away from the hub 200 by the peripheral camming surface 210, which assures a more effective electrical contact. In one mode of operation, the resilient electrical contact blades 300 are flexed into electrical contact for an intermittent period while the peripheral camming surface 210 is moved into contact with the blade 300 nearest the hub 200. In other modes of operation, the blade may be retained in electrical contact for an extended time period by leaving the peripheral camming surface positioned in engagement with the nearest blade. An alternative peripheral camming surface extending over a greater angular dimension of the hub 200, not shown in the drawing, will facilitate this alternative mode of operation.

The housing 100 includes at least two wire apertures 180. Each wire aperture 180 is aligned with a corresponding wire engagement portion of the resilient electrical contact blade 300 wherein a wire W disposed through the wire aperture 180 is electrically connectable with the wire engagement portion of the resilient electrical contact blade 300. In one embodiment, each resilient electrical contact blade 300 includes two wire engagement portions, and the housing includes four wire apertures 180 wherein each wire aperture 180 is aligned with a corresponding wire engagement portion to provide for parallel electrical connections of the electrical switch assembly.

In one embodiment, a first housing portion 120 is matably engageable with a second housing portion 130 wherein the first and second housing portions 120 and 130 form a fluid resistant interface so as to prevent fluid from entering the housing 100. FIG. 1 shows the first housing portion 120 including an inner hub recess with a top surface 122 and a side surface 126 for rotatably receiving the hub 200, and the second portion of the housing 130 including an interior collar with a side surface 134 about which the hub 200 is rotatable. A fluid resistant inner interface is formed by a top surface 230 of the hub 200 in slidable contact with the top surface 122 of the recess and by a bottom surface 240 of the hub 200 in slidable contact with an interior surface of the second housing 130. In an alternative embodiment, the top surface 122 of the recess includes an annular rib 128 protruding into a corresponding annular recess 232 in the top surface 230 of the hub 200 so as to provide a fluid resistant serpentine path to the interior of the housing 100. A fluid resistance outer interface is formed between a peripheral surface 125 of the first housing portion 120 and a mating peripheral surface 135 of the second housing portion 130. Tight tolerances between the mating housing surfaces and hub provide an interface substantially impermeable to splashing fluid, which is encountered most frequently in many applications. In one embodiment, the first housing portion 120 includes recesses 121 for receiving resilient tabs 131 disposed on the second housing portion 130 so as to retain the housing portions 120 and 130 in fluid resistant mating relationship. The first and second housing portions 120 and 130 and the 200 hub are preferably unitary members formable of polysulfone, rated at 160 degrees C, in a molding process. Alternative embodiments are formable of other natural and synthetic insulating materials.

The housing 100 includes at least two wire sockets 190 for receiving a wire W with an insulating sheath S. Each wire socket 190 communicates with a corresponding wire aperture 180 so as to provide access to the corresponding wire engagement portion of the resilient electrical contact blade 300. Each wire socket 190 includes a conical inner surface portion 192 engageable with the insulating sheath S disposed about the wire W so as to form a fluid resistant seal. The wire sheath S is retained in sealing engagement with the conical inner surface portion 192 by the wire engagement portion of the resilient electrical contact blade 300. In another embodiment shown in FIG. 1, the wire socket 190 includes one or more ridges 196 for preventing twisting of the sheathed wire W within the socket 190, which may result in disconnection of the wire W from the wire engaging portion of the resilient electrical contact blade 300. In yet another embodiment, the housing 100 includes a blade access aperture 198 adjacent each wire socket 190 for providing access to the corresponding wire engagement portion of the resilient electrical contact blade 300 for releasing the wire W without damage from the wire engagement portion as discussed below. Each blade access aperture 198 includes a breakable partition wall 199 to seal the housing 100 from external fluid wherein the partition wall 199 is breakable to provide access to the corresponding wire engagement portion of the resilient electrical contact blade 300.

Figure 3:
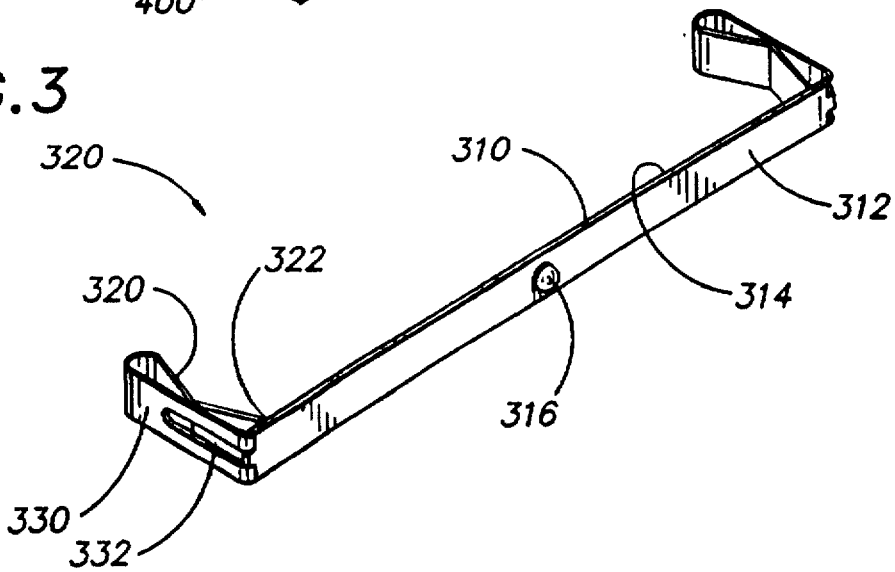
FIG. 3 is a perspective view of a resilient electrical contact blade according to an exemplary embodiment of the invention.

FIG. 3 is a perspective view of a resilient electrical contact blade 300 according to an exemplary embodiment of the invention wherein the blade includes a resilient body portion 310 with a contact surface 312 and a backside 314. In one embodiment, the contact surface 312 includes an electrical contact member 316, which may have an arcuate shape to reduce electrical arcing. Each wire engaging portion of the resilient electrical contact blade 300 includes a resilient leg 320 with an edge portion 322 biased toward a retention surface. In the embodiment of FIG. 3, the retention surface is the backside 314 of the resilient body 310. A base 330 with a slot-shape hole 332 interconnects the resilient body 310 with the resilient leg 320 wherein the resilient leg 320 extends from the base 330 toward the backside 314 of the resilient body 310. The blade 300 is fabricated of a unitary metal strip wherein the holes 332 and electrical contact member 316 are reliably and inexpensively formed in a stamping process. The substantially similar resilient electrical contact blades 300 are interchangeable, and are made in the same process, which reduces fabrications costs and simplifies assembly. The resilient electrical contacts blades 300 may be a beryllium copper alloy or phosphor bronze, although other conductive materials may be used.

FIGS. 1 and 2 show the pair of substantially similar resilient electrical contact blades 300 of the exemplary type shown in FIG. 3 mounted within the housing 100. The blades 300 are arranged in a substantially mirror image configuration wherein the contact surfaces 312 of the blade face each other, and the contact members 316 are in opposing alignment. Each hole 332 in the wire engagement portion of the blade 300 is aligned with a corresponding wire aperture 180 in the housing 106. A combination of inner mounting blocks 160 and outer mounting blocks 170 position the pair of blades 300 within the housing 100 in electrical isolation, and inner side walls 138 of the housing 100 prevent lateral movement of the blades. The mounting blocks 160 and 170 may be sized or arranged to slightly flex the blades 300 for retaining the blades 300 in position until the blades 300 are encased between the assembled first and second housing portions 120 and 130.

The wire W is insertable into the housing 100 through the wire aperture 180 and is electrically connectable with the wire engagement portion of the resilient electrical contact blade 300. In the embodiment of FIGS. 1–3, the wire W is extended through the hole 332 in the base 330 of the blade 305 and flexes the resilient leg 320 away from the backside 314 of the blade 300 so as to permit insertion of the wire W between the edge portion 322 and the backside 314 whereby the wire W is retained in electrical contact with the resilient electrical contact blade 300. The edge portion 322 and retention surface prevent retraction of the engaged wire W from the housing 100. The hole 332 in the base portion 330 provides contact with side portions of the wire W, which prevents the wire from sliding out from between the edge portion 322 and the retention surface 314. FIG. 2 shows a wire W engaged by the wire engaging portion of the resilient electrical contact blade 300, which also maintains the insulating sheathing S in fluid resistance contact with the conical portion 192 of the wire socket 190 as discussed above. To release the wire W from the wire engaging portion of the resilient electrical contact blade 300, the resilient leg 320 must be flexed away from the wire W so as to disengage the edge portion 322 from the wire W whereupon the released wire W may be withdrawn without damage from the housing 100. Access to the resilient leg 320 is gained by inserting an elongate member, not shown in the drawing, into the blade access port 198 of the housing 100 and through the breakable partition wall 199.

Figure 4:
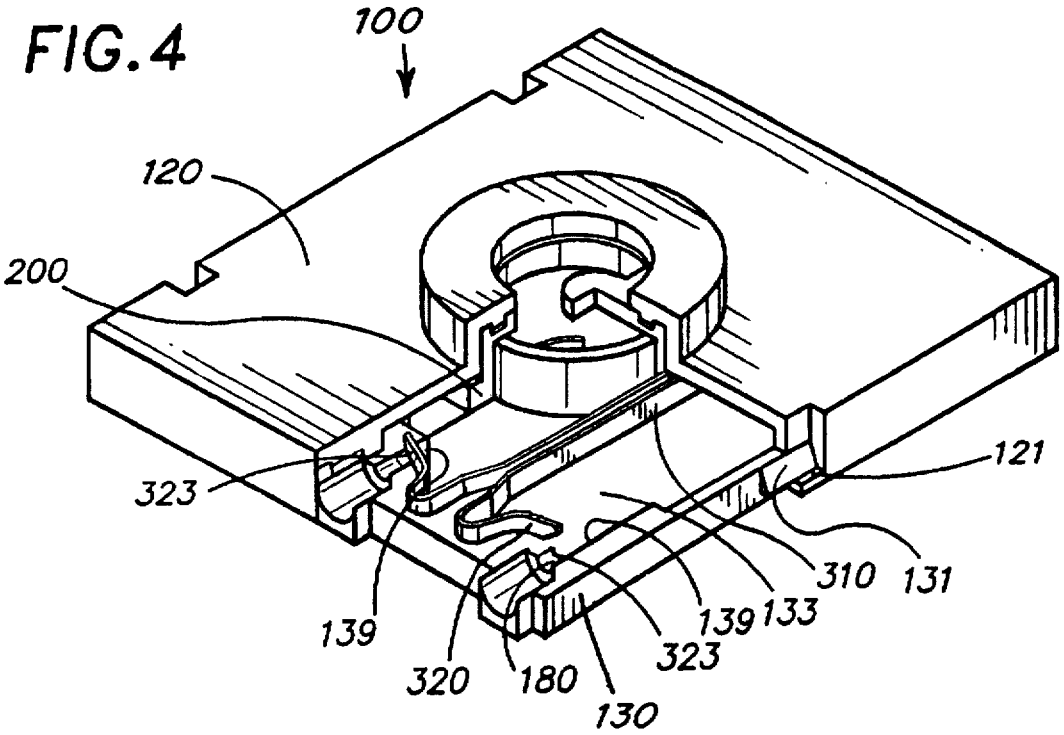
FIG. 4 is a partial perspective view of an electrical switch assembly according to an alternative embodiment of the invention.

FIG. 4 is a partial perspective view of an electrical switch assembly with a pair of substantially similar resilient electrical contact blades 300 each having a resilient body portion 310 and a resilient leg 320 with a V-notched edge portion 323 biased toward a retention surface. According to this alternative embodiment, however, the retention surface is a side wall 139 on the interior of the housing 130. The spacing between the wire apertures 180 in the embodiment of FIG. 4 is greater than the spacing between the wire apertures 180 in the embodiments of FIGS. 1 and 2. In operation, the wire W is extended into the housing 100 and flexes the resilient leg 320 away from the side wall 139 so as to permit insertion of the wire W between the V-notched edge 323 and the side wall 139 whereupon the wire W is retained in electrical contact with the resilient electrical contact blade 300. The V-notch edge 323 prevents the wire W from sliding out from between the edge 323 and the retention surface, or side wall 139.

Figure 5:
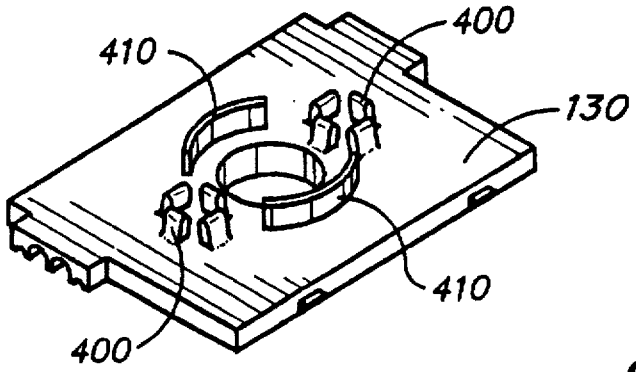
FIG. 5 is a partial perspective view of a mounting member for mounting the electrical switch assembly according to an exemplary embodiment of the invention.

In operation, the electrical switch assembly of the present invention is fixedly mounted relative to the rotatable member that actuates the switch assembly. In one embodiment, one of the first and second housing portions 120 and 130 includes a mounting member for mounting the electrical switch assembly. FIG. 5 illustrates a mounting member on the housing portion 130 for coupling the switch assembly to a gas valve assembly of the standard type known as a Lincoln Brass Valve, commonly used in gas cooking appliances, not shown in the drawing. The mounting member includes one or more substantially annular arrangements of resilient prongs 400 protruding from an outer surface of the housing 130. Each substantially annular arrangement of resilient prongs 400 is outwardly flexible so as to surround and engage a corresponding bolt or screw head protruding from the gas valve assembly. The mounting member may alternatively include one or more support members 410 for stabilizing the electrical switch assembly relative to the gas valve assembly. The resilient prongs 400 and support members 410 are preferably fabricated as a part of the unitary housing portion, which is formable in a molding process discussed above. Alternative embodiments, may include mounting members configured for coupling with other structure including other types of gas valves like the Harper-Wyman gas valve, which is also commonly used in gas cooking appliance applications.

While the foregoing written description of the invention enables anyone skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. An electrical switch assembly actuatable by a rotatable member, comprising:

a housing having an aperture defined therein;

a hub rotatably disposed within said housing, a peripheral camming surface defined upon said hub, and aperture means defined within said hub and accessible through said housing aperture for receiving the rotatable member such that said hub is rotatable with respect to said housing when said rotatable member is rotatably engaged within said aperture means of said hub; and a pair of resilient electrical contact blades disposed within said housing at locations which are in spaced relation with respect to each other, said resilient electrical contact blades having at least one wire engagement portion for engageable connection with an electrical wire and being substantially similar to each other in configuration so as to be interchangeable with each other at said locations within said housing, said hub being rotatable by said rotatable member so as to cause said peripheral camming surface of said hub to be engaged with one of said resilient electrical contact blades and thereby cause flexure of said engaged one of said resilient electrical contact blades into electrical contact with the other one of said resilient electrical contact blades.

2. The electrical switch assembly of claim 1, wherein:

said housing comprises a first housing portion matably engagable with a second housing portion, so as to form a fluid resistant interface which prevents fluid from entering said housing.

3. The electrical switch assembly of claim 1, wherein:

said housing includes at least two wire sockets wherein each wire socket has a narrowed wire aperture for receiving a wire connectable with said wire engagement portion of a corresponding resilient electrical contact blade disposed within said housing, and a conical inner surface portion engagable with an insulating sheath disposed about said wire so as to form a fluid resistant seal.

4. The electrical switch assembly of claim 3, wherein:

said housing includes a blade access aperture disposed adjacent to each one of said at least two wire sockets for permitting insertion of a tool into said housing so as to release the engagement of said wire engagement portion of said resilient electrical contact blade from its corresponding wire, each one of said blade access apertures having a partition wall operatively associated therewith so as to render said housing fluid-resistant wherein said partition wall is breakable so as to provide access to a corresponding wire engagement portion of a corresponding resilient electrical contact blade by said tool.

5. The electrical switch assembly of claim 1, wherein:

said housing includes at least two wire apertures wherein each wire aperture is aligned with a wire engagement portion of a corresponding resilient electrical contact blade whereby a wire disposed through one of said wire apertures is able to be electrically connectable with a wire engagement portion of a corresponding resilient electrical contact blade.

6. The electrical switch assembly of claim 5, wherein:

each one of said resilient electrical contact blades includes two wire engagement portions; and said housing includes four wire apertures wherein each wire aperture is aligned with a corresponding wire engagement portion of said resilient electrical contact blades.

7. The electrical switch assembly as set forth in claim 6, wherein:

each one of said resilient electrical contact blades has a substantially U-shaped configuration.

8. The electrical switch assembly of claim 5, wherein:

said wire engagement portion of each one of said resilient electrical contact blades comprises a resilient leg having an edge portion biased toward a retention surface wherein said resilient leg is flexible so as to be moved away from said retention surface as a wire is disposed through a corresponding wire aperture so as to permit insertion of said wire between said edge portion of said resilient leg and said retention surface whereby said wire is held in electrical contact with said resilient electrical contact blade.

9. The electrical switch assembly according to claim 5, wherein:

said wire engagement portion of each one of said resilient electrical contact blades comprises a base portion with a hole defined therein and a resilient leg extending from said base portion and toward a retention surface of said resilient electrical contact blade wherein said resilient leg is flexible so as to be moved away from said retention surface of said resilient electrical contact blade as a wire is disposed through one of said wire apertures of said housing and through said hole in said base portion of a corresponding wire engagement portion of a resilient electrical contact blade so as to permit insertion of said wire between an edge portion of said resilient leg and said retention surface of said resilient electrical contact blade whereby said wire is held in electrical contact with said resilient electrical contact blade.

10. The electrical switch assembly of claim 1 wherein the housing includes a mounting member for mounting the electrical switch assembly in a fixed orientation relative to the rotatable member.

11. The electrical switch assembly of claim 10, wherein:

said mounting member includes at least one substantially annular arrangement of resilient prongs protruding from an outer surface of said housing for engagement with a screw head protruding from a valve assembly so as to fix said assembly upon said valve assembly.

12. An electrical switch assembly actuatable by a rotatable member, comprising:

a housing having an aperture defined therein;

a hub rotatably disposed within said housing, a peripheral camming surface defined upon said hub, and aperture means defined within said hub and accessible through said housing aperture for receiving the rotatable member such that said hub is rotatable with respect to said housing when said rotatable member is rotatably engaged within said aperture means of said hub;

a pair of resilient electrical contact blades disposed within said housing at locations which are in spaced relation with respect to each other, each one of said pair of resilient electrical contact blades having at least one wire engagement portion for engageable connection with an electrical wire;

said housing comprising at least two wire sockets for receiving electrical wires connectable with said wire engagement portion of a corresponding resilient electrical contact blade disposed within said housing, and a blade access aperture disposed adjacent to each one of said at least two wire sockets for permitting insertion of a tool into said housing so as to release the engagement of said wire engagement portion of said resilient electrical contact blade from its corresponding electrical wire, each one of said blade access apertures having a partition wall operatively associated therewith so as to render said housing fluid-resistant, wherein said partition wall is breakable so as to provide access to a corresponding wire engagement portion of a corresponding resilient electrical contact blade by said tool so as to disengage said corresponding wire engagement portion of said corresponding resilient electrical contact blade from its corresponding electrical wire; and said hub being rotatable by said rotatable member so as to cause said peripheral camming surface of said hub to be engaged with one of said resilient electrical contact blades and thereby cause flexure of said engaged one of said resilient electrical contact blades into electrical contact with the other one of said resilient electrical contact blades.

13. The electrical switch assembly as set forth in claim 12, wherein:

each one of said resilient electrical contact blades comprises two wire engagement portions; and said housing comprises four wire sockets wherein each wire socket is aligned with a corresponding wire engagement portion of said resilient electrical contact blades such that a wire disposed within one of said wire sockets is able to be electrically connected to a wire engagement portion of a corresponding resilient electrical contact blade.

14. The electrical switch assembly as set forth in claim 13, wherein:

each one of said resilient electrical contact blades has a substantially U-shaped configuration.

15. The electrical switch assembly as set forth in claim 12, wherein:

said wire engagement portion of each one of said resilient electrical contact blades comprises a base portion with a hole defined therein and a resilient leg extending from said base portion and toward a retention surface of said resilient electrical contact blade wherein said resilient leg is flexible so as to be moved away from said retention surface of said resilient electrical contact blade when a wire is disposed through one of said wire sockets of said housing and through said hole in said base portion of a corresponding wire engagement portion of a resilient electrical contact blade so as to permit insertion of said wire between an edge portion of said resilient leg and said retention surface of said resilient electrical contact blade whereby said wire is held in electrical contact with said resilient electrical contact blade.

16. An electrical switch assembly actuatable by a rotatable member, comprising:

a housing having an aperture defined therein;

a hub rotatably disposed within said housing, a peripheral camming surface defined upon said hub, and aperture means defined within said hub and accessible through said housing aperture for receiving the rotatable member such that said hub is rotatable with respect to said housing when said rotatable member is rotatably engaged within said aperture means of said hub;

a pair of resilient electrical contact blades disposed within said housing at locations which are in spaced relation with respect to each other, each one of said pair of resilient electrical contact blades having at least one wire engagement portion for engageable connection with an electrical wire;

said housing comprising at least two wire sockets for receiving electrical wires connectable with said wire engagement portion of a corresponding resilient electrical contact blade disposed within said housing, and a blade access aperture disposed adjacent to each one of said at least two wire sockets for permitting insertion of a tool into said housing so as to release the engagement of said wire engagement portion of said resilient electrical contact blade from its corresponding electrical wire; and said hub being rotatable by said rotatable member so as to cause said peripheral camming surface of said hub to be engaged with one of said resilient electrical contact blades and thereby cause flexure of said engaged one of said resilient electrical contact blades into electrical contact with the other one of said resilient electrical contact blades.

17. The electrical switch assembly as set forth in claim 16, wherein:

each one of said resilient electrical contact blades comprises two wire engagement portions; and said housing comprises four wire sockets wherein each wire socket is aligned with a corresponding wire engagement portion of said resilient electrical contact blades such that a wire disposed within one of said wire sockets is able to be electrically connected to a wire engagement portion of a corresponding resilient electrical contact blade.

18. The electrical switch assembly as set forth in claim 17, wherein:

each one of said resilient electrical contact blades has a substantially U-shaped configuration.

19. The electrical switch assembly as set forth in claim 16, wherein:

said wire engagement portion of each one of said resilient electrical contact blades comprises a base portion with a hole defined therein and a resilient leg extending from said base portion and toward a retention surface of said resilient electrical contact blade wherein said resilient leg is flexible so as to be moved away from said retention surface of said resilient electrical contact blade when a wire is disposed through one of said wire sockets of said housing and through said hole defined within said base portion of a corresponding wire engagement portion of a resilient electrical contact blade so as to permit insertion of said wire between an edge portion of said resilient leg and said retention surface of said resilient electrical contact blade whereby said wire is held in electrical contact with said resilient electrical contact blade.

20. An electrical switch assembly actuatable by a rotatable member, comprising:

a housing having an aperture defined therein;

a hub rotatably disposed within said housing, a peripheral camming surface defined upon said hub, and aperture means defined within said hub and accessible through said housing aperture for receiving the rotatable member such that said hub is rotatable with respect to said housing when said rotatable member is rotatably engaged within said aperture means of said hub;

a pair of resilient electrical contact blades disposed within said housing at locations which are in spaced relation with respect to each other, each one of said pair of resilient electrical contact blades having at least one wire engagement portion for engageable connection with an electrical wire;

said hub being rotatable by said rotatable member so as to cause said peripheral camming surface of said hub to be engaged with one of said resilient electrical contact blades and thereby cause flexure of said engaged one of said resilient electrical contact blades into electrical contact with the other one of said resilient electrical contact blades; and said housing comprising at least one substantially annular arrangement of resilient prongs integral with and protruding from an outer surface portion of said housing for engagement with a screw head protruding from a gas valve assembly of a gas appliance so as to snap-fittingly mount said electrical switch assembly upon said gas valve assembly of said gas appliance.

21. The electrical switch assembly as set forth in claim 20, wherein:

each one of said resilient electrical contact blades comprises two wire engagement portions; and said housing comprises four wire sockets for receiving electrical wires connectable with said wire engagement portions of said resilient electrical contact blades wherein each wire socket is aligned with a corresponding wire engagement portion of said resilient electrical contact blades such that a wire disposed within one of said wire sockets is able to be electrically connected to a wire engagement portion of a corresponding resilient electrical contact blade.

22. The electrical switch assembly as set forth in claim 21, wherein:

each one of said resilient electrical contact blades has a substantially U-shaped configuration.

23. The electrical switch assembly as set forth in claim 20, wherein:

said wire engagement portion of each one of said resilient electrical contact blades comprises a base portion with a hole defined therein and a resilient leg extending from said base portion and toward a retention surface of said resilient electrical contact blade wherein said resilient leg is flexible so as to be moved away from said retention surface of said resilient electrical contact blade when a wire is disposed through one of said wire sockets of said housing and through said hole defined within said base portion of a corresponding wire engagement portion of a resilient electrical contact blade so as to permit insertion of said wire between an edge portion of said resilient leg and said retention surface of said resilient electrical contact blade whereby said wire is held in electrical contact with said resilient electrical contact blade.

* * * * *